US005292015A

United States Patent [19]

Bumbera

[11] Patent Number: 5,292,015

[45] Date of Patent: Mar. 8, 1994

[54] DISPLAY STAND

[75] Inventor: Jeffrey B. Bumbera, Spring Lake, Mich.

[73] Assignee: Harbor Industries, Inc., Grand Haven, Mich.

[21] Appl. No.: 849,745

[22] Filed: Mar. 11, 1992

[51] Int. Cl.[5] ..... A47F 5/00

[52] U.S. Cl. ..... 211/189; 211/133

[58] Field of Search ..... 211/133, 189, 206, 50, 211/186, 70.2, 59.4

[56] References Cited

U.S. PATENT DOCUMENTS

| | | | |
|---|---|---|---|
| D. 31,291 | 7/1899 | Moore . | |
| D. 93,540 | 10/1934 | Cubicciotti . | |
| D. 158,464 | 5/1950 | Hopp . | |
| D. 201,332 | 6/1965 | Caldwell . | |
| D. 213,344 | 2/1969 | Freedman . | |
| D. 231,720 | 6/1974 | Wolff . | |
| D. 247,532 | 3/1978 | Tenney . | |
| D. 255,631 | 7/1980 | Sniderman . | |
| D. 256,195 | 8/1980 | Scalice . | |
| D. 228,110 | 8/1973 | Kerman . | |
| 300,361 | 6/1884 | Hale . | |
| D. 305,187 | 12/1989 | Kaufman, Jr. . | |
| 658,359 | 9/1900 | Emmer . | |
| 1,477,428 | 12/1923 | Corbett . | |
| 2,428,853 | 10/1947 | Procter . | |
| 2,754,130 | 7/1956 | Procter . | |
| 3,217,078 | 11/1965 | Kleiber . | |
| 3,538,863 | 11/1970 | Howard et al. . | |
| 3,561,375 | 2/1971 | Hammond . | |
| 3,782,296 | 1/1974 | Moretini . | |
| 3,902,633 | 9/1975 | Spengler . | |
| 4,030,608 | 6/1977 | Howard . | |
| 4,380,298 | 4/1983 | Harig | 211/189 |
| 4,469,232 | 9/1984 | Lusch | 211/189 |
| 4,501,369 | 2/1985 | Fox . | |
| 4,585,131 | 4/1986 | Crossman et al. . | |
| 4,678,089 | 7/1987 | Lang . | |
| 4,760,927 | 8/1988 | Dechirot . | |
| 4,771,898 | 9/1988 | Howard et al. . | |
| 4,800,821 | 1/1989 | Nook et al. . | |
| 4,805,783 | 2/1989 | Mayer | 211/189 X |
| 4,938,549 | 7/1990 | Potter . | |
| 4,980,112 | 12/1990 | Masters . | |
| 5,000,329 | 3/1991 | Luberto . | |

FOREIGN PATENT DOCUMENTS

| | | |
|---|---|---|
| 638106 | 3/1964 | Belgium . |
| 1064920 | 8/1965 | United Kingdom . |

OTHER PUBLICATIONS

The copied pages from Creative Magazine dated May 1991, disclose various display stands, several of which utilize a plurality of interchangeable bases with a hole, and a plurality of upper frames that insert into the hole. The article "New Dimensions in Rotomolding", from the Apr. 1966 issue of Modern Plastics discloses various products utilizing rotomolding.

The Handbook of Common Polymers, dated Jun. 20, 1973, notes that resins can be used for decorative displays.

*Primary Examiner*—Robert W. Gibson, Jr.

*Attorney, Agent, or Firm*—Price, Heneveld, Cooper, Dewitt & Litton

[57] ABSTRACT

A display includes a rotary molded base with an elongate protrusion located along the parting line of the molded base, and further includes a frame having a pair of elongate legs with shaped grooves therein, the protrusion and grooves being slideably engageable to securely retain the frame over the base. The base further includes a concavely shaped face for receiving a flexible panel therein. Multiple frames are engageable with the base. Also, an embodiment of a frame leg is provided for interconnecting two bases placed side-by-side. Also, an embodiment including an extrusion having a sectional shape adapted to facilitate forming the frame is provided.

29 Claims, 5 Drawing Sheets

DISPLAY STAND

BACKGROUND OF THE INVENTION

The present invention pertains to display stands, and in particular to a display stand having a unique base, frame, and base-to-frame interconnection.

Increasingly, merchandisers are interested in display stands which are easy to assemble and use, but which provide the flexibility necessary to permit adaptation to various merchandising needs. For example, some merchandise is best displayed by use of brochures (e.g. large or bulky merchandise), while other merchandise is best displayed on rotating turntables (e.g. low cost jewelry) or lockable shelves (e.g. watches or expensive jewelry). Further, needs change as various items are displayed, thus necessitating the need to change the display stands to various types Also, it is desirable to exhibit product logos or other advertising information along with the products or items presented for viewing.

SUMMARY OF THE INVENTION

The present invention includes a display stand having a base with opposing sides, a frame with at least two elongate members spaced from each other and extending in parallel, and a connecting arrangement including a tongue like protrusion and groove means for slideably releasably engaging the elongate members to the opposing sides to securely support the frame in an upright position over the base. In the preferred embodiment, the base is formed by rotary molding and includes a parting line, and the tongue and groove means includes an elongate protrusion that extends at least partially along the parting line of the base. The frame includes C-shaped grooves in the elongated members that operably engage the elongate protrusions.

The present invention is seen to offer several advantages over known art. The base of the preferred embodiment provides a common base which can be used to support multiple and different frames. Further, the assembly and disassembly of the frames to the base is relatively easy. Also, the base is relatively non-complex, and is low cost to manufacture without the need for substantial secondary finishing operations. Additionally, the base is particularly suited for rotary molding, since the base is a relatively large part which can be made from a durable plastic and will usually be made in relatively low volumes or runs. Also, the base incorporates a recess for receiving advertising materials and the like. Further, the frame includes an extrusion that can be connected to in multiple ways, and which simplifies frame construction.

These and other features, objects and advantages of the present invention will become apparent to one of ordinary skill in the art upon reading the following description thereof together with reference to the accompanied drawings.

DETAILED DESCRIPTION OF THE PREFERRED EMBODIMENT

Figure 1:
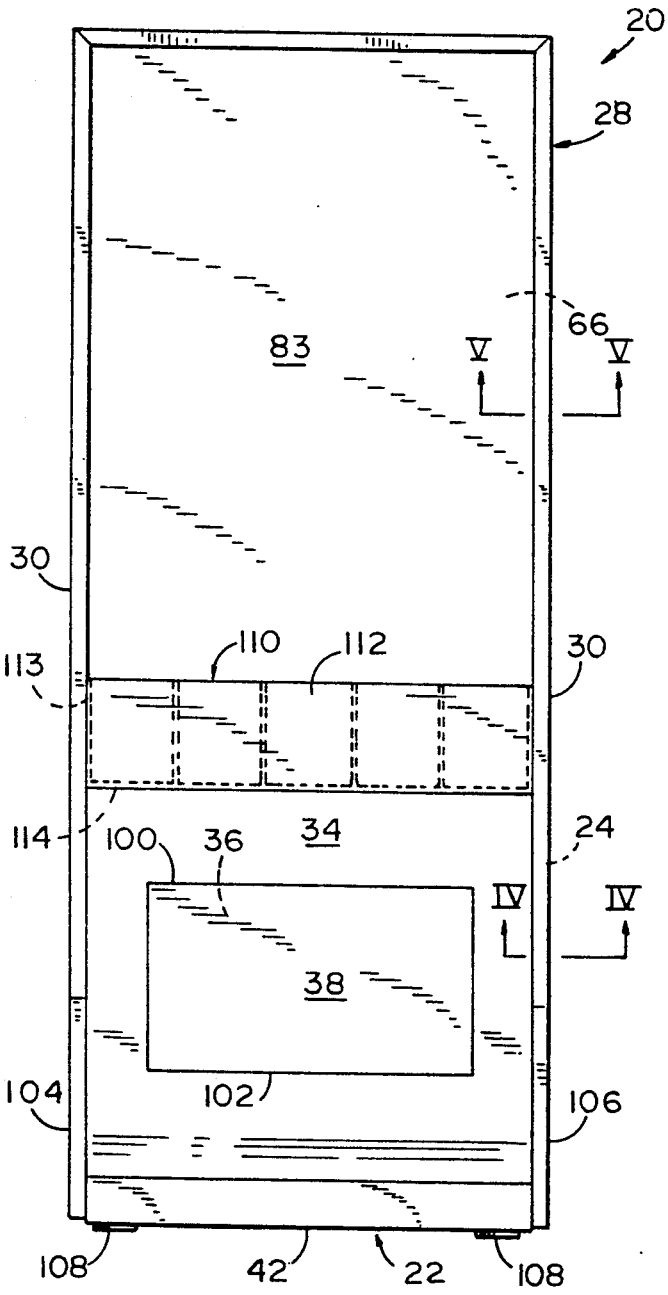
FIG. 1 is a front view of a display stand embodying the present invention.
Figure 4:
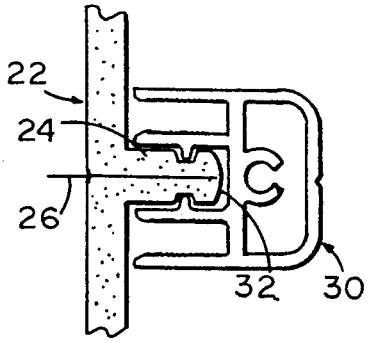
FIG. 4 is a sectional view taken along the plane IV—IV in FIG. 1.

A display stand 20 (FIG. 1) embodying the present invention includes a rotary molded base 22 with elongate tongues or protrusions 24 located along a parting line 26 that extends around molded base 22 (FIG. 4), and further includes a frame 28 having a pair of elongate members or legs 30 with C-shaped grooves 32 therein, the protrusions 24 and grooves 32 being slideably engageable in a tongue-and-groove-like fashion to securely retain frame 28 over base 22. Base 22 further includes a pair of concavely-shaped faces 34 each having a recess 36 therein for receiving a resiliently flexible panel 38 such as for displaying advertising material, a logo or pricing information.

Figure 2:
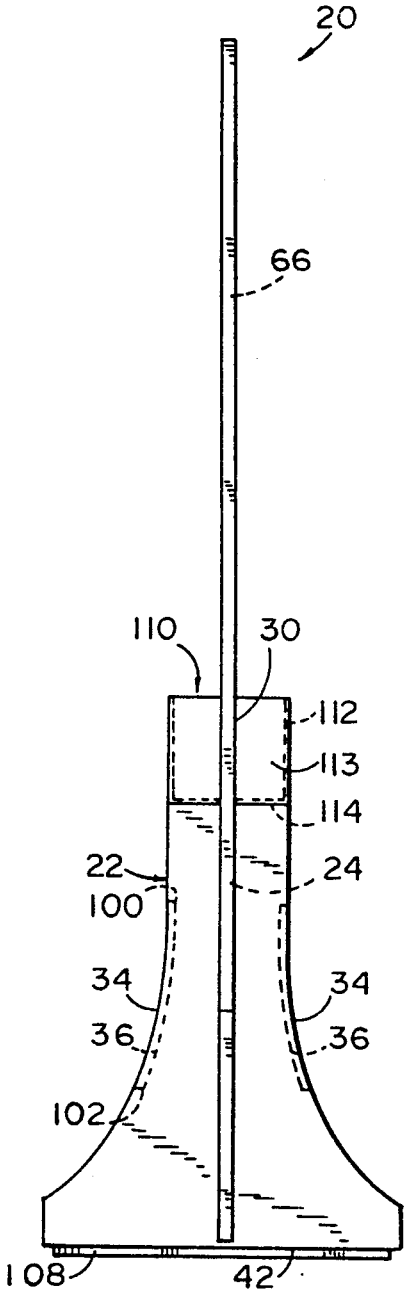
FIG. 2 is a side view of the display stand shown in FIG. 1.

Base 22 (FIGS. 1–3) is a hollow molded body made of polypropylene or other durable structural plastic material. It is contemplated that base 22 will be made a process called rotary or rotational molding wherein polypropylene pellets are placed in a shaped mold (not shown) and are gradually fused together as the shaped mold is simultaneously heated and rotated. Base 22 is particularly suited for rotary molding due to its non-complex but large shape. Rotary molding has a relatively low mold cost when compared to other molding methods such as injection molding, which is important due to the low production runs expected for base 22. Further, rotary molding permits molding a relatively large part such as base 22 with sufficient weight and a sufficiently large bottom surface to provide the necessary stability for display stand 20. Also, rotary molding permits molding base 22 into a substantially finished product which is durable, aesthetically pleasing, and functional as molded without significant secondary operations being required such as forming, finishing or assembling of subparts to make a finished base 22. Notably, though a rotary molded base 22 is shown, it is contemplated that base 22 can be made by a number of different ways.

Figure 6:
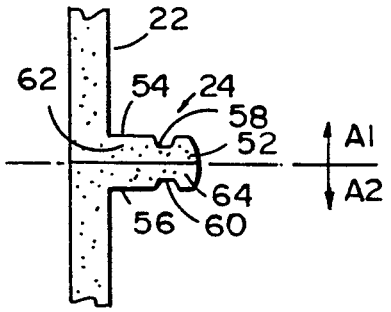
FIG. 6 is a sectional view of the protrusion in FIG. 4.

Base 22 (FIG. 3) includes a top 40, a bottom 42, opposing parallel planar sides 44 and 46, and opposing concavely shaped sides 48 and 50, with sides 48 and 50 including faces 34. Parting line 26 extends 360° around base 22 across top 40, bottom 42, and sides 44 and 46, and is defined by the contacting surfaces of the rotary mold halves as the mold halves are closed. The portion of parting line 26 extending across sides 44 and 46 includes outwardly extending elongate protrusions 24. Protrusions 24 are uniquely shaped (FIG. 6) with a head 52 and opposing sides 54 and 56, sides 54 and 56 having elongate grooves or depressions 58 and 60 therein. Optimally, protrusions 24 can be made with depressions 58 and 60 integrally molded therein during the rotary molding process. This is possible since depressions 58 and 60 extend normally to the plane defined by parting line 26. Thus, depressions 58 and 60 do not create an in-line interference in the mold halves (not shown) as the mold halves are separated as noted by arrows "A1" and "A2". Optimally, protrusion 24 includes a stem 62 and neck 64 of sufficient dimension to permit particles or pellets of the plastic to flow freely into the area of protrusion 24 before the particles or pellets are fused together.

Figure 5:
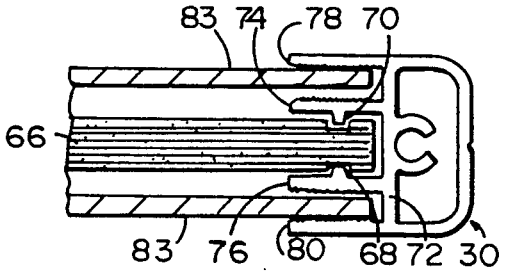
FIG. 5 is a sectional view taken along the plane V—V in FIG. 1.
Figure 7:
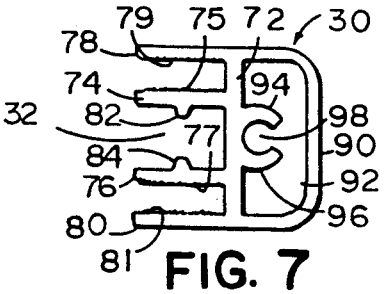
FIG. 7 is a sectional view of the leg in FIG. 4.
Figure 10:
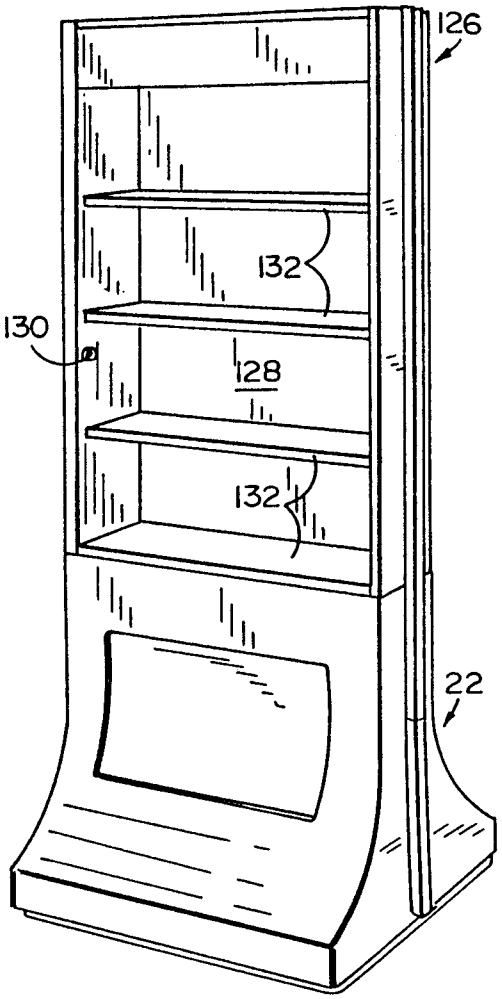
FIG. 9–13 are perspective views illustrating various frames which can be used with the base shown in FIG. 1.
Figure 9:
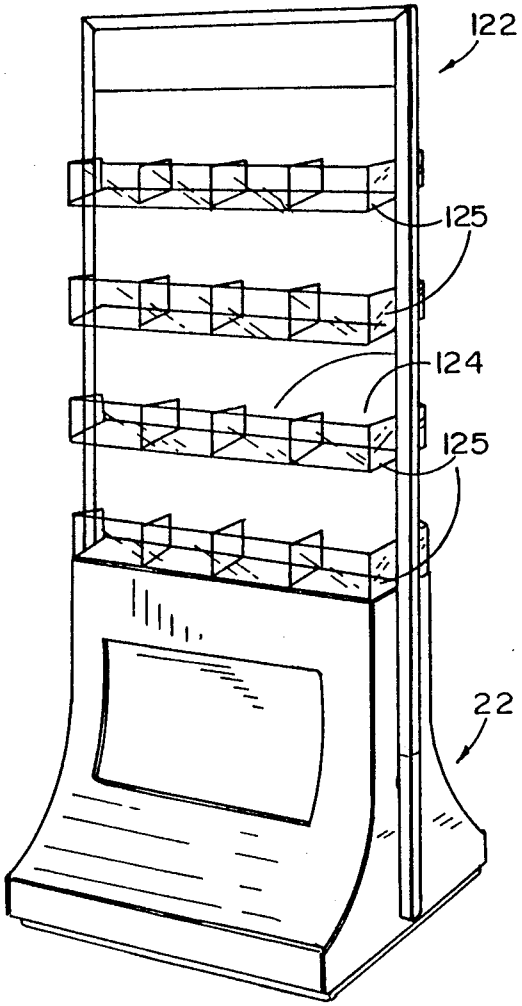

Frame 28 (FIGS. 1 and 5) includes an upper inner panel 66 with depressions 68 and 70 adjacent the side edges of inner panel 66, allowing inner panel 66 to engage the upper part of C-shaped grooves 32 in legs 30 similar to the manner in which protrusions 24 engage C-shaped grooves 32. Legs 30 (FIG. 7) comprise an extrusion having a central web 72 with inner parallel webs 74 and 76 and outer parallel webs 78 and 80 extending perpendicular to central web 72. Inner webs 74 and 76 include inwardly extending opposing lips or ridges 82 and 84 that join with the base of webs 74 and 76 and a middle portion of central web 72 to form C-shaped groove 32. Outer webs 78 and 80 are spaced apart to form a pocket for receiving head 52 and stem 62 of protrusion 24, with lips 82 and 84 engaging depressions 58 and 60 about protrusion neck 64. Thus, each leg 30 can be securely and matingly slid onto protrusions 24 into a securely retained arrangement.

The outer surface 75 and 77 of inner webs 74 and 76 and also the inner surfaces 79 and 81 of outer webs 78 and 80 are serrated in a longitudinal direction such that they are adapted to retainably receive advertising panels 83 (FIG. 5) which are made of heavy cardboard or like material having a thickness sufficient to fill the space between webs 74 and 78 and also between webs 76 and 80.

Legs 30 also include an outer arcuate loop or web 90 that extends from the terminal ends of central web 72 forming an open space 92. Open space 92 is useful such as for routing electrical wires (not shown) from base 22 through legs 30 to frame 28. Between central web 72 and arcuate outer web 90 on central web 72 are opposing short flanges 94 and 96 that form an opening 98, opening 98 being useful for retaining a snap-in clip (not shown) such as for managing the electrical wires mentioned above. Also, flanges 94 and 96 serve to reinforce and strengthen legs 30.

Concave sides 48 and 50 (FIGS. 2 and 3) of base 22 include a curvlinear-shaped recess 36 with opposing upper and lower ledges 100 and 102, respectively, defined at the operative edges of recess 36. Ledges 100 and 102 are useful for abutting the edges of flexible panel 38 therein. As flexible panel 38 is flexed, it can be pressed into the arcuate shape of recess 36 between ledges 100 and 102 to operably retain panel 38 therein.

Base 22 (FIGS. 1 and 2) also includes secondary extensions 104 and 106 that are extrusions having a similar sectional profile to legs 30. Extensions 104 and 106 attach to the sides of base 22 on the lower part of protrusions 24. Secondary extensions 104 and 106 can be attached to the side of base 22 to abut the terminal ends of legs 30 to control the vertical height of frame 28. Alternatively, frame 28 can rest on top 40 as noted below with secondary extensions 104 and 106 only serving as aesthetic covers for the lower part of protrusions 24. Base 22 also can include feet such integral feet 108, although adjustable feet or other leveling means are contemplated.

Figure 3:
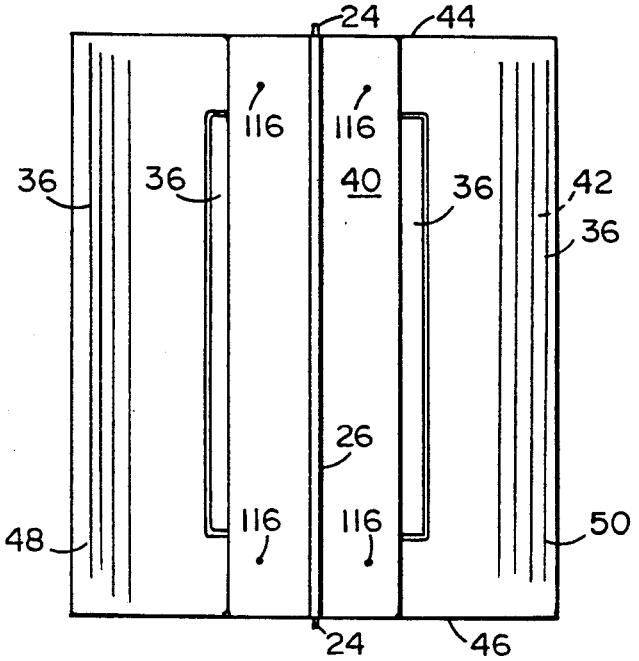
FIG. 3 is a top view of the base of the display stand shown in FIG. 1.

Multiple and different frames are contemplated for use in the present invention. Frame 28 (FIGS. 1–2 and 8) includes brochure pockets 110 formed by panels 112, 113 and 114. As shown, pockets 110 can be securely mounted to the top 40 of base 22 adjacent the lower end of of inner panel 66 by attachment screws (not shown) which thread into holes 116 of base 22 (FIG. 3). Alternatively, frame 28 and brochure pockets 110 can be held o base 22 by other methods, such as by extending panel 114 under inner panel 66.

Figure 8:
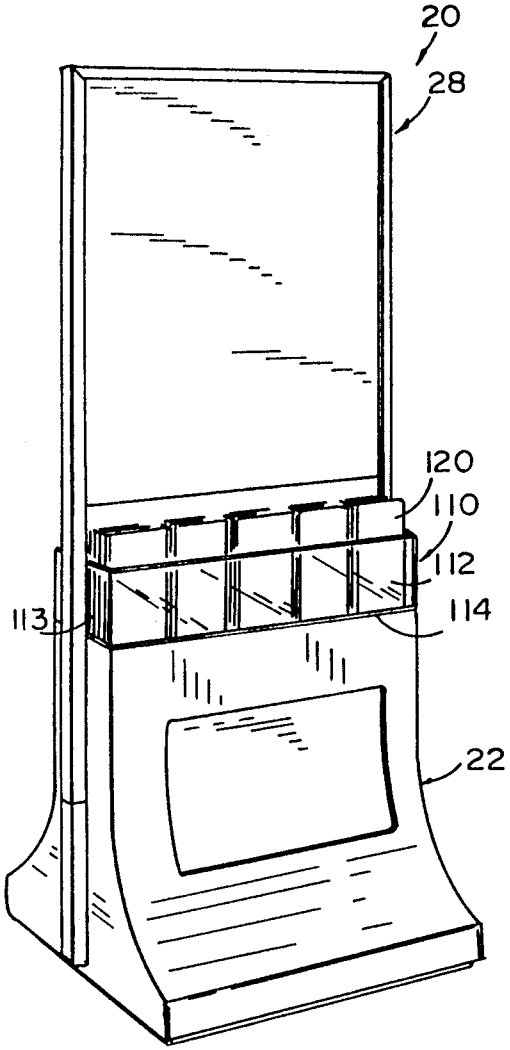
FIG. 8 is a perspective view of the display stand in FIG. 1.
Figure 13:
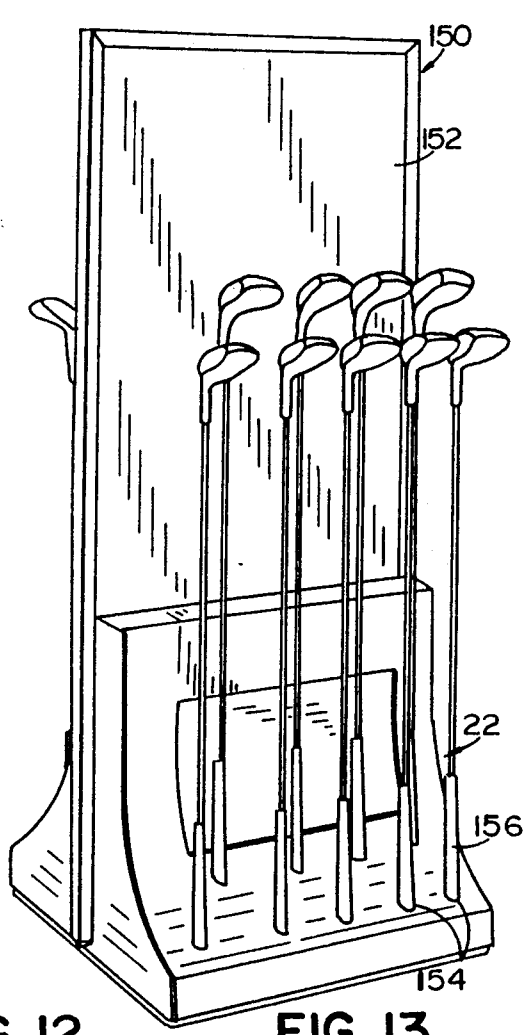
Figure 12:
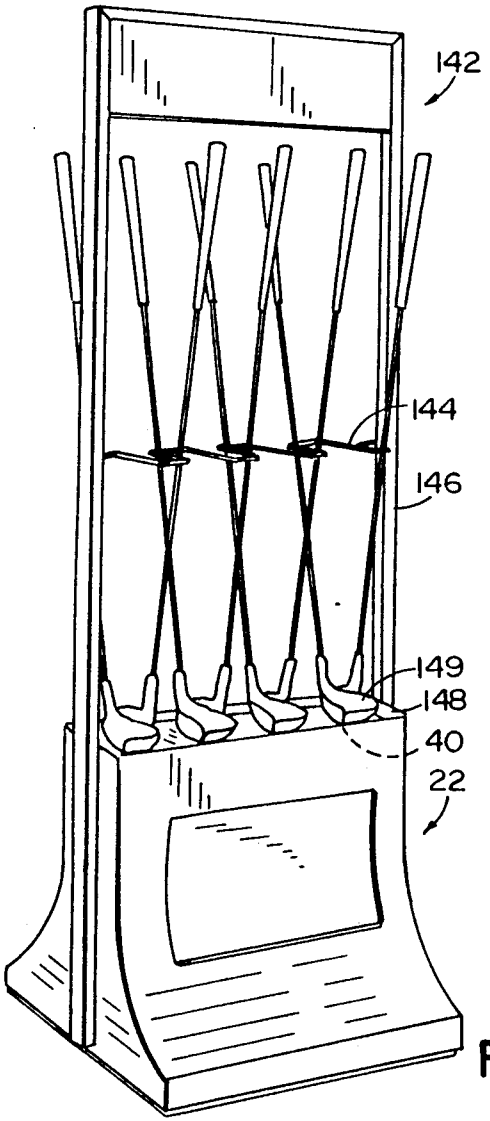
Figure 11:
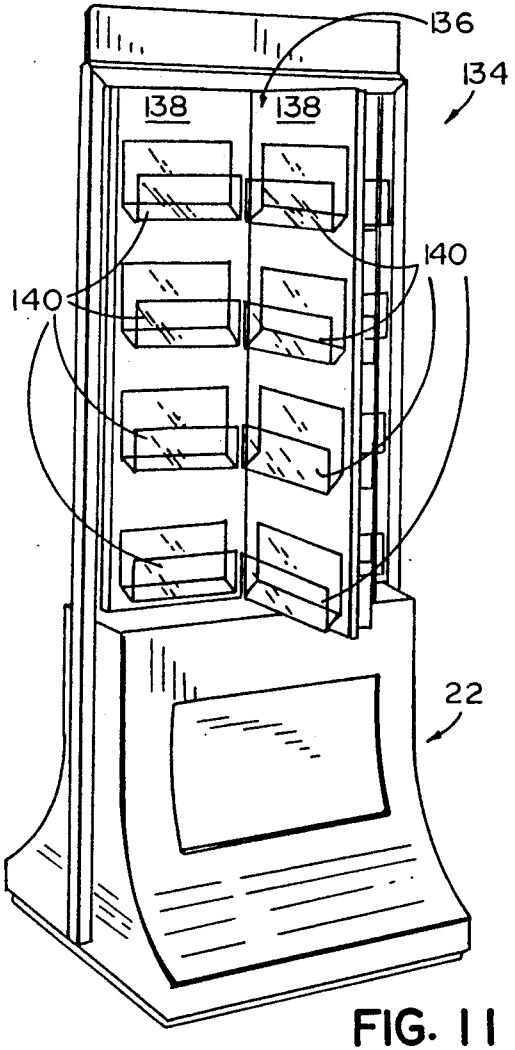

FIGS. 8–13 illustrate the various types of different frames that can be used with base 22. FIG. 8 illustrates frame 28 including brochures 120 which have been placed in pockets 110. Frame 122 (FIG. 9) is adapted to receive multiple brochures or small items of merchandise into pockets 124 on shelves 125. Frame 126 (FIG. 10) has a lockable door 128 including lock 130, and shelves 132. Frame 134 (FIG. 11) includes a turntable 136 having rotatable sides 138 with trays or pockets 140 thereon. Frame 142 (FIG. 12) is shown with a retaining member or bent wire 144 extending between frame legs 146. Also, top 40 of base 22 is adapted with a tray 148 to retain merchandise therein, such as golf club heads 149 as shown. Frame 150 (FIG. 13) shows yet another frame adapted to hold golf clubs. However, frame 150 merely holds a display panel 152 that is similar to panel 83 in frame 28 (FIG. 5), while base 22 is adapted with holes 154 to receive the handles of golf clubs 156 to hold same in an erect and upright position.

Figure 14:
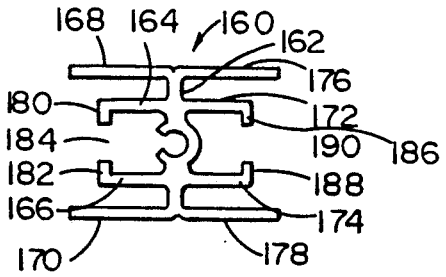
FIG. 14 is a sectional view of a second embodiment of a frame leg.
Figure 15:
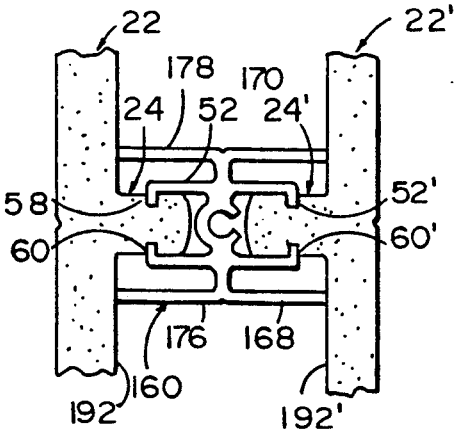
FIG. 15 is a sectional view of the leg in FIG. 14 as assembled to two adjacent bases.

A second embodiment of a frame leg is shown in FIG. 14 and generally referred to as frame leg 160. Frame leg 160 is useful such as for holding two bases 22 and 22' together side-by-side to form an enlarged display stand. Frame leg 160 comprises an extrusion having a central web 62 with inner parallel webs 164 and 166 and outer parallel webs 168 and 170 extending perpendicular to central web 162 from a first direction, and inner parallel webs 172 and 174 and outer parallel webs 176 and 178 extending perpendicular in an opposite direction from central web 162. Inner webs 164 and 166 include inwardly extending opposing lips or ridges 180 and 182 that join with the middle portion of central web 72 to form a C-shaped groove 184. Also, inner parallel webs 172 and 174 include inwardly extending opposing lips 186 and 188 that join with webs 172 and 174 and a middle portion of central web 162 to form a C-shaped groove 190, C-shaped groove 190 being opposite C-shaped groove 184 on central web 162. Outer webs 168 and 170 are spaced apart to form a pocket for mateably receiving head 52 of protrusion 24 of base 22, with lips 180 and 182 engaging depressions 58 and 60 about protrusion neck 64. Similarly, outer webs 176 and 178 are spaced apart to form a second pocket for receiving another protrusion 24' of an adjacently positioned base 22' with lips 186 and 188 engaging depressions 58' and 60' about protrusion neck 64 on the second base 22'. Thus, frame leg 160 can be securely and matingly slid onto protrusions 24 and 24, into a securely retained arrangement whereby bases 22 and 22' are interconnected adjacently to form a united combination display stand as shown in FIG. 15. As illustrated, the terminal ends of outer parallel webs 168 and 170 and also 176 and 178 contact the outer surface 192 of bases 22 to add stability to the inner connection.

Figure 16:
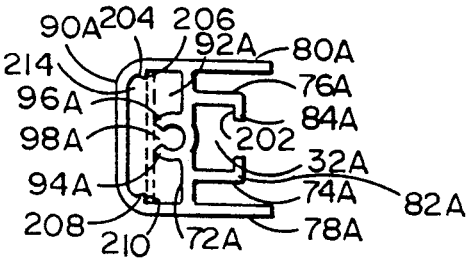
FIG. 16 is a sectional view of a third embodiment of a frame leg.

A third embodiment of a frame leg 200 is shown in FIG. 16. Frame leg 200 is similar to frame leg 30 shown in FIG. 7, and similar parts are shown with a letter "A" designation. The sectional profile of frame leg 200 differs from leg 30 in the following areas. Inner parallel webs 74A and 76A end at lips 82A and 84A, a distance short of the plane defined by the terminal ends of outer parallel webs 78A and 80A. Further, the inner surface 202 on lips 82A and 84A is serrated longitudinally. Also, outer arcuate loop or web 90a includes inwardly extending protrusions 204 and 208. Protrusions 204 and 208 define an inner surface 206 and 210 that aligns with central web 72A. Surfaces 206 and 210 form a pocket with short flanges 90A and 94A for receiving a flat tab or leg 214 (shown in phantom) as discussed below.

Figure 17:
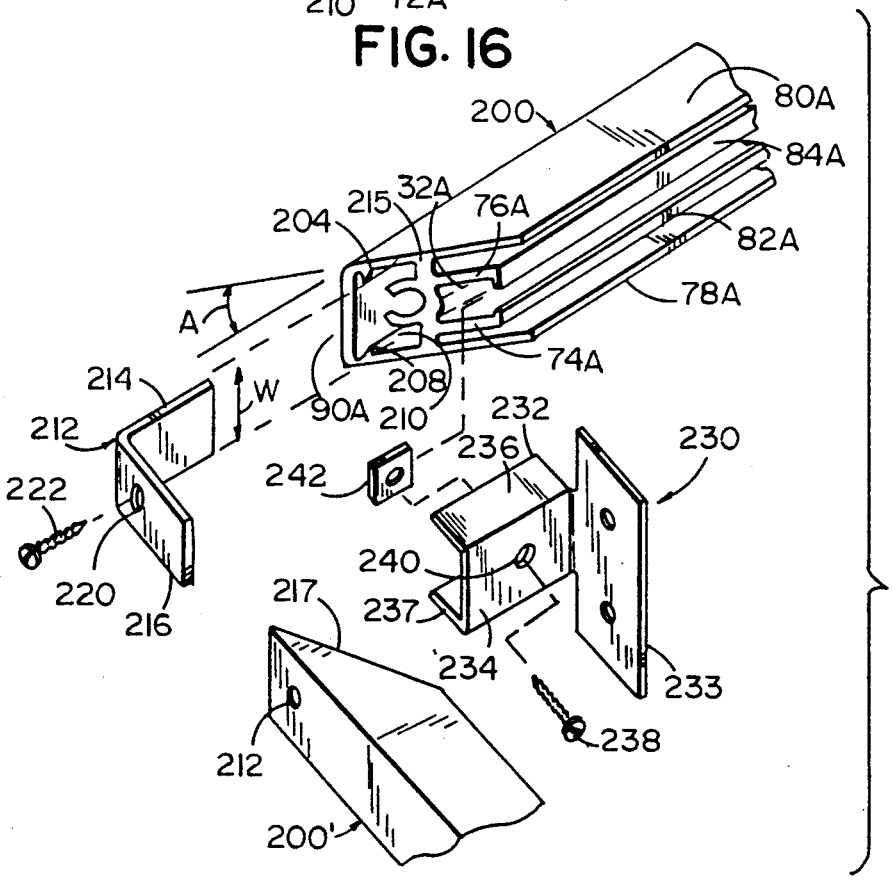
FIG. 17 is an exploded fragmentary view of a frame corner and side bracket.

Two frame leg segments 200 and 200' (FIG. 17) are shown oriented perpendicularly to each other, each having an end cut at an angle of 45° as shown by angle "A". An L-shaped bracket 212 having a width "W" can be positioned in open space 92A on protrusions 204 and 208 between a first plane defined by surfaces 206 and 210, and a second plane defined by the free terminal ends of opposing short flanges 94A and 96A. With the first flat leg 214 of L bracket 212 inserted into the angled end 215 of frame leg 200, and the second flat leg 216 of L bracket 212 inserted into the angled end 217 of a second frame leg segment 200', L bracket 212 reinforces the 90° joint thereby formed. The 90° joint can be further strengthened by securing the 90° joint with a screw 222. This is done by drilling a hole 218 through the angled end of the frame legs 200', and drilling a second hole 220 in second leg 216 of L bracket 212. With holes 218 and 220 aligned with each other and with opening 98A between short flanges 94A and 96A, a self-threading screw 222 can be screwed therethrough, with the threads of screw 222 threading into the inner sides of flanges 94A and 96A. Notably, as screw 222 and/or bracket legs 214 and 216 are lengthened or strengthened, the 90° joint is also strengthened.

A second L bracket 230 includes a lower first leg 232 and a perpendicular second leg 233. First leg 232 includes a crosswise wall 234 for resting on the outer ends of lips 82A and 84A, and further includes normally extending flanges 236 and 237 that are adapted to fit between webs 76A and 80A, and also between webs 74A and 78A, respectively. A screw 238 is placed through aperture 240 in crosswise wall 234 and into a nut 242. Nut 242 has a width dimension that is less than the distance between inner parallel walls 74A and 76A, but includes a diagonal dimension that is greater than the distance between inner webs 74A and 76A such that nut 242 can slip therebetween longitudinally along frame leg 200, but cannot rotate while nut 242 is in the C-shaped groove defined as 32A. Thus, second L bracket 230 can be slid along the length of frame leg 200 until a desired position is reached, at which time screw 238 can be tightened on nut 242 to draw cross wall 234 of L bracket 230 tightly against the terminal ends of inner wall 74A and 76A and against the outer surfaces on lips 82A and 84A. L bracket 230 can be used for a number of different purposes such as for attaching frame leg 200 securely to top 40 of base 22, or to hold various shelves and the like once a frame has been formed from joining frame legs 200 at their angled corners.

Thus, a display stand is provided with a base and upper frame that can be readily assembled, the base accepting a variety of different upper frame members in a secure manner to hold the frames upright securely over the base. It will become apparent to those skilled in the art that various modifications to the preferred embodiment of the invention can be made without departing from the spirit or scope of thereof as defined by the appended claims.

The embodiments of the invention in which an exclusive property or privilege is claimed are defined as follows.

1. A display comprising:

a preformed base having front and back surfaces interposed between a pair of upstanding sides;

a display frame with at least two elongate members extending in parallel and spaced from each other complimentary to the spacing of said sides; and a connecting arrangement wherein one of said upstanding sides and said elongate members includes a tongue-like protrusion and the other of said upstanding sides and said elongate members includes a mating groove means for interlockingly engaging said tongue-like protrusion to permit releasable sliding engagement of said members with said sides whereby said frame can be releasably mounted to and supported by said base.

2. A display as set forth in claim 1 wherein said elongate members are made of a rigid material

3. A display as set forth in claim 2 wherein said protrusion and groove means are slideably engageable and disengageable in a first direction, and are laterally interlocked to prevent disassembly from a direction different than said first direction.

4. A display as set forth in claim 3 wherein said base includes said protrusion and said protrusion includes a head with opposing depressions therein, and said elongate members each form a shaped groove for receiving said head and engaging said opposing depressions.

5. A display as set forth in claim 4 wherein said base includes a parting line, and said protrusion is located along at least a portion of said parting line on said base.

6. A display as set forth in claim 5 wherein said protrusion is formed as an integral part of said base.

7. A display as set forth in claim 6 wherein said base is molded by rotary molding.

8. A display as set forth in claim 3 wherein said base includes a parting line, and said protrusion is located along at least a portion of said parting line.

9. A display as set forth in claim 1 wherein said base is a molded piece made by rotary molding.

10. A system including a display as set forth in claim 1 and further including a plurality of said frames.

11. A display as set forth in claim 1 wherein said front surface includes a shaped face with opposing ledges adapted to receive a panel having information printed thereon.

12. A display as set forth in claim 1 wherein said shaped face is concavely shaped so that the panel can be held between said ledges in a bowed condition.

13. A display as set forth in claim 1 including a pair of said preformed bases positioned side by side, and wherein at least one of said two elongate members includes means for interlocking connecting said two bases together.

14. A display as set forth in claim 13 wherein said pair of bases each include one of said protrusions, and said one elongate member includes opposing groove means, each of said groove means being adapted to securely engage said one protrusion on each of said bases.

15. A display comprising:

a base including opposing upstanding sides, an elongate protrusion extending vertically on at least one of said upstanding sides, said elongate protrusion having side surfaces with connecting means therein; and a display frame with at least one elongate member extending therefrom, said elongate member including a shaped portion for engaging said connecting means on said protrusion to securely connect said frame to said base.

16. A display as set forth in claim 15 wherein said connecting means includes opposing depressions in said side surfaces, and said shaped portion of said frame includes a shaped groove with lips for engaging said opposing depressions.

17. A display as set forth in claim 15 wherein said protrusion is integrally molded to said base.

18. A display as set forth in claim 15 wherein said base includes a parting line, and said protrusion extends along at least a portion of said parting line.

19. A display as set forth in claim 15 wherein said base is a molded piece.

20. A display as set forth in claim 19 wherein said base is rotary molded.

21. A display as set forth in claim 15 wherein said base includes a shaped face with opposing ledges adapted to receive a panel having information printed thereon.

22. A display as set forth in claim 21 wherein said shaped face is concavely shaped so that the panel can be held between said ledges in a bowed condition.

23. A preformed base for a display comprising:

a main portion including a parting line formed around said main portion; and a connecting portion extending along a part of said parting line, said connecting portion including at least one elongate protrusion with groove means therein, said connecting portion being adapted to securely engage a shaped elongate member extending from a display frame, said connecting portion being integrally molded as a part of said main portion.

24. A base as set forth in claim 23 wherein said base is made by a plastic molding process.

25. A base as set forth in claim 24 wherein said base is formed by rotary molding.

26. A base as set forth in claim 23 wherein said base includes opposing sides that are substantially parallel and include said part of said parting line, one of said protrusions being located on each of said opposing sides.

27. A base as set forth in claim 23 wherein said base includes a shaped face with opposing ledges adapted to receive a panel with information printed thereon.

28. A base as set forth in claim 23 wherein said shaped face is concavely shaped so that the panel can be held between said ledges in a bowed condition.

29. A system comprising:

a preformed molded base of hollow construction defining concavely-shaped front and back surfaces adapted to receive and display panels with information thereon, and further including a pair of upstanding sides, said upstanding sides being spaced from each other and including connecting means integrally molded thereto; and a plurality of display frames having a pair of rigid elongate members extending in parallel and spaced from each other complimentary to the spacing of said sides, said pair of elongate members being shaped to permit releasable sliding engagement of said members for releasably mounting same to and supporting same by said base, said plurality of display frames including at least a first frame that provides pockets for holding articles, a second frame that provides a lockable arrangement for holding articles, and a third frame that provides a movable holder for articles.

* * * * *

UNITED STATES PATENT AND TRADEMARK OFFICE

CERTIFICATE OF CORRECTION

PATENT NO. : 5,292,015
DATED : March 8, 1994
INVENTOR(S) : Jeffrey B. Bumbera

It is certified that error appears in the above-indentified patent and that said Letters Patent is hereby corrected as shown below:

Column 1, line 18;
After "types" insert —.—.

Column 2, line 7;
"FIG." should be —FIGS.—.

Column 4, line 12;
"o base" should be —on base—.

Column 4, line 38;
"62" should be —162—.

Column 4, line 61;
"24 and 24" should be —24 and 24'—.

Column 6, line 61;
"interlocking" should be —interlockingly—.

Signed and Sealed this

Twentieth Day of September, 1994

Bruce Lehman

*Attest:*

BRUCE LEHMAN

*Attesting Officer*

*Commissioner of Patents and Trademarks*